United States Patent [19]

Tsao

[11] Patent Number: 4,975,181

[45] Date of Patent: Dec. 4, 1990

[54] PROCESS AND APPARATUS FOR ETHYLENE PRODUCTION

[76] Inventor: Utah Tsao, 1887 Kennedy Blvd., Jersey City, N.J. 07305

[21] Appl. No.: 433,972

[22] Filed: Nov. 9, 1989

Related U.S. Application Data

[63] Continuation of Ser. No. 680,267, Dec. 10, 1984.

[51] Int. Cl.[5] ..... C10G 9/32

[52] U.S. Cl. ..... 208/127; 208/159; 208/160; 422/145; 422/235

[58] Field of Search ..... 208/127, 48 Q, 157, 208/159, 160; 422/145, 146, 234, 235

[56] References Cited

U.S. PATENT DOCUMENTS

| | | | |
|---|---|---|---|
| 2,485,315 | 10/1949 | Rex et al. | 208/127 |
| 2,506,317 | 5/1950 | Rex | 208/159 X |
| 2,751,756 | 6/1956 | Hughes et al. | 208/159 X |
| 2,874,093 | 2/1959 | Moser, Jr. | 208/53 |
| 2,877,278 | 3/1959 | Moser, Jr. | 280/127 |
| 2,906,689 | 9/1959 | Moser, Jr. | 208/53 |
| 2,943,042 | 6/1960 | Stokes et al. | 208/127 |
| 2,943,994 | 7/1960 | McCain, Jr. | 208/127 |
| 4,057,490 | 11/1977 | Wynne, Jr. | 208/127 |
| 4,097,303 | 6/1978 | McKinney et al. | 208/127 |

*Primary Examiner*—Glenn Caldarola
*Attorney, Agent, or Firm*—Louis E. Marn

[57] ABSTRACT

There is disclosed an improved process and apparatus for the pyrolysis of a heavy hydrocarbon feed utilizing a transfer line reactor wherein pyrolysis reaction temperatures are achieved by contact of the heavy hydrocarbon feed with heated solid particles immediately followed by quenching of the pyrolysis gaseous effluent with cooled solid-particles in the transfer line reactor to maximize ethylene production and minimize the effect of secondary reactions.

25 Claims, 1 Drawing Sheet

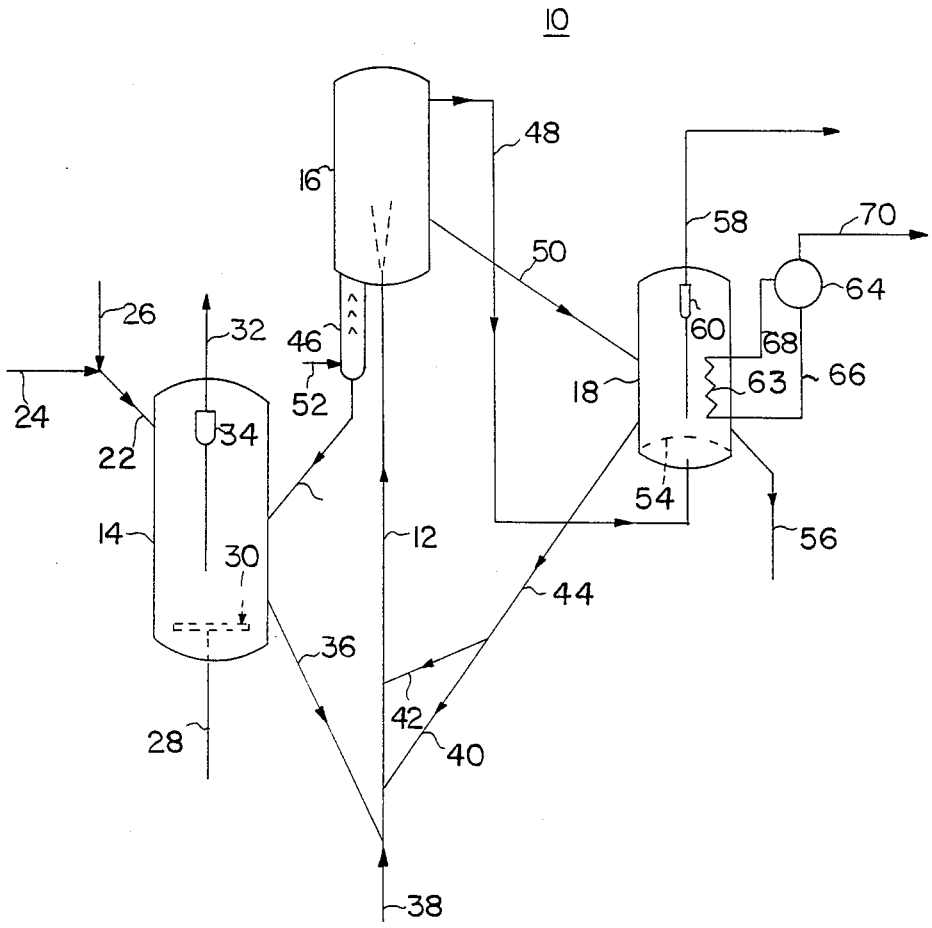
10
16
48
58
70
50
64
26
32
46
60
68
24
52
18
63
66
22
34
54
14
12
56
30
44
36
42
28
40
38

PROCESS AND APPARATUS FOR ETHYLENE PRODUCTION

This is a continuation, of application Ser. No. 06/680,267, filed Dec. 10, 1984.

FIELD OF THE INVENTION

This invention relates to a process and apparatus for the production of ethylene, and more particularly to a process and apparatus for the production of ethylene by the pyrolysis of heavy hydrocarbon utilizing transfer line reactor techniques.

BACKGROUND OF THE INVENTION

Heater designs for effecting the pyrolysis of naptha to form ethylene have operated on low heat rates where the conversion of naptha to ethylene ranges from about 12 to 26 percent. Such heaters have included two parallel coils and a two zone radiant heating section to permit varying of the heating profile. Horizontal tube type heaters have metallurgical limitations of the tube supports when firing such heaters at intense service conditions as well as presenting serious expansion problems.

In U.S. Pat. No. 3,274,978 to Palchik et al and assigned to the same assignee as the present invention, there is disclosed a short residence heater of the vertical tube type having parallel radiant heating zones with a single convention zone disposed thereabove in fluid communication with the radiant heating zones. By locating high intensity radiant burners on either side of a single row of absorbing surfaces or coils permit the attainment of high heat absorption rates at concomitant low residence times. The coil is designed for residence times of about 0.3 second, generally from about 0.2 to 0.5 second at average heat rates of 20,000 to 30,000 B.t.u./hr./sq.ft. At such low residence times, high outlet temperatures in the order of about 1500° to 1550° F. are required for the decomposition of the feed to form the desired olefins before coke condensation reactions become significant.

The lower limit of residence times in such tubular type heaters is limited by the maximum heat rate allowable and the practical limit of the smallness of the tube diameter. Thus, high pyrolysis temperatures are required for heavy hydrocarbon feeds with vaporization of the feed in the tube resulting in coke build-up, it being understood that high ethylene yields are achieved by high pyrolysis temperatures and short residence times.

Higher pyrolysis temperatures have been achieved utilizing transfer line exchangers wherein pyrolyzing temperatures are achieved by admixing heated solids with the hydrocarbon feed to be pyrolyzed, such as disclosed in U.S. Pat. Nos. 4,057,490 and 4,172,857 to Wynne and Pavilon, respectively. In U.S. Pat. No. 4,057,490 to Wynne, crushed oil shale is heated to a temperature of from 1300° to 2500° F. prior to introduction into the riser, whereas in U.S. Pat. No. 4,172,857 to Pavilon, agglomerated ash particles formed by burning particles of coal or other solid carbonaceous material are introduced into the riser reactor.

In ethylene production, it is most important to stop the reaction within a predetermined time, or to at least substantially rapidly reduce the reaction rate, in order to avoid the formation of by-products and residues resulting from secondary reactions and to thereby maximize the yield of the desired product. Thus, the hydrocarbon feed is introduced into a reaction zone at a very high throughput rate and rapidly brought to reaction temperature, and maintained at this temperature for a time period which may be on the order of a fraction of a second. Under these conditions ethylene is the primary resulting product.

If the reaction products are not cooled immediately, secondary reactions, such as polymerization, takes place with a resulting production of tars and coke and a reduction in ethylene yields. Aside from such evident disadvantages, there is the fact that if such secondary reactions are allowed to take place, the tars and coke which are produced tend to clog and block the pipelines, valves and other components of the apparatus with concomitant complicated maintenance problems and frequent plant shutdown.

OBJECTS OF THE PRESENT INVENTION

An object of the present invention is to provide an improved process and apparatus for producing a pyrolysis effluent including ethylene from a heavy hydrocarbon.

Another object of the present invention is to provide an improved process and apparatus for producing a pyrolysis effluent including ethylene from a heavy hydrocarbon with improved ethylene yields.

A further object of the present invention is to provide an improved process and apparatus for producing a pyrolysis effluent including ethylene from a heavy hydrocarbon of improved ethylene yields utilizing a transfer line reactor and the quenching of the pyrolysis effluent by cooled solids preferably cake particles.

Yet a further object of the present invention is to provide an improved process and apparatus for producing a pyrolysis effluent including ethylene from a heavy hydrocarbon of improved ethylene yields utilizing transfer line reactor techniques substantially eliminating the attendant problems of coke, tar and other heavy hydrocarbons.

Still another object of the present invention is to provide an improved process and apparatus for producing a pyrolysis effluent including ethylene from a heavy hydrocarbon of improved ethylene yields utilizing transfer line reactor techniques with solids produced by the combustion of comminuted coke particles.

A still further object of the present invention is to provide an improved process and apparatus for producing a pyrolysis effluent including ethylene from a heavy hydro carbon of improved ethylene yields utilizing transfer line reactor techniques with solids produced by the combustion of comminuted coal and limestone particles to reduce sulfur oxide pollution.

Yet another object of the present invention is to provide an improved process and apparatus for producing a pyrolysis effluent including ethylene from a heavy hydrocarbon of improved ethylene yields utilizing transfer line reactor techniques of affording substantial economies.

Still another object of the present invention is to provide a novel process and apparatus for producing a pyrolysis effluent including ethylene whereby the pyrolysis effluent is quenched with cooled coke particles to enhance adsorption of tars, coke and other heavy materials.

SUMMARY OF THE INVENTION

These and other objects of the present invention are achieved in a transfer line reactor wherein pyrolysis reaction temperatures are achieved by contact of a heavy hydrocarbon feed with heated solid particles immediately followed by quenching of the pyrolysis gaseous effluent with cooled solid particles in the transfer line reactor. In one aspect of the present invention, the heated solid particles are formed by burning comminuted coal particles in the presence of limestone to fix sulphur oxides as calcium base compounds.

BRIEF DESCRIPTION OF THE DRAWING

A better understanding of the present invention as well as other objects and advantages thereof will become apparent upon consideration of the detailed disclosure thereof, especially when taken with the accompanying drawing of a schematic flow diagram of the process and apparatus of the present invention.

DETAILED DESCRIPTION OF THE INVENTION

It is to be understood that certain equipment, such as valves and indicators, and the like have been omitted from the drawing to facilitate the description hereof, and the placment of such equipment at appropriate places is deemed to be within the scope of one skilled in the art.

Referring now to the drawing, there is illustrated a transfer line reactor assembly, generally indicated as 10, and comprised of a transfer line reactor 12, a fluidized coke heater 14, a separator 16 and a cooler 18. The fluidized bed combustion boiler 14 is provided with a recycle solids inlet conduit 20, a fresh solids inlet conduit 22 in solids communication with solids supply conduit 24 for the introduction of comminuted coke particles or like carbonaceous particles for start up procedure and a solids supply conduit 26 for the introduction of comminuted limestone, as more fully hereinafter described. The fluidized coke heater 14 is provided with a gas inlet conduit 28 for the introduction of an oxygen-containing gas, such as air into the boiler 14 via the fluidize bed distribution assembly, generally indicated as 30, and with a gas outlet conduit 32 including cyclone separator 34. Hot solid particles are withdrawn by solids conduit 36 for introduction into the generally vertically-disposed transfer line reactor 12.

A portion of the transfer line reactor 12 below the solids conduit 36 is provided with a feed inlet conduit 38. Above the juncture of the solids conduit 34 with the transfer line reactor 12, there are provided on the transfer line reactor 12, solids conduits 40 and 42 in solids communications by line 44 with the cooler 18, as more fully hereinafter described. The upper portion of the transfer line reactor 12 is in gas-solid communication with the separator 16 including stripper portion 46. The separator 16 is provided with an outlet gas conduit 48 and a solids outlet conduit 50 in gas and solids communication, respectively, with the cooler 18. The stripper portion 46 of the separator 16 is provided with a stripping gas inlet conduit 52 with the lower portion of the stripper portion 46 being in solids communication with the fluidized coke heater 14 via the conduit 20.

The cooler 18 is provided with a fluidized bed grid 54, a solids outlet conduit 56 and a gas outlet conduit 58 including cyclone separator 60, and is in gas and solids communication by conduits 48 and 50, respectively, with the separator 16, as hereinabove described. The cooler 18 is provided with a heat transfer coil 62 in fluid communication with a steam drum 64 by a liquid conduit 66 and a steam conduit 68. The stream drum 64 is provided with a steam outlet line 70.

In operation, solid particles of coke or like carbonaceous material heated to a temperature of from 800° to 1700° F., preferably from 1200° to 1600° F., are introduced by line 36 into the transfer line reactor 12 and contact an atomized heavy hydrocarbon feed at a pressure of from 2 to 10 atmosphere, absolute introduced by line 38 into the transfer line reactor 12 at weight ratios of heated solid particles to heavy hydrocarbon feed of from 25:1 to 1:1, preferably 15:1. The large surface area of the heated solid particles substantially instantaneously heat the heavy hydrocarbon feed to pyrolysis temperatures of from 300° to 1500° F., preferably from 500° to 1400° F., at pressures of 2 to 10 atmospheres, absolute.

Coke is a particularly preferred solid material since direct quench of the effluent from the pyrolysis of heavy hydrocarbons with cooled coke particles enhances the adsorption of tar, coke or other heavy material. The use of coke particles has by far the advantage of being of like material as the absorbed coke and is of a high heat capacity, readily burned in the coke heater.

As hereinabove discussed, elevated pyrolysis temperatures favor ethylene production whereas extended residence times favor secondary reactions including char formation. To substantially arrest or halt the pyrolysis reaction after a desired residence time of from 0.02 to 1 seconds, cooled solid particles at a temperature of from 500° to 1000° F., preferably from 700° to 900° F., are introduced by line 40 and/or line 42 into the transfer line reactor 12. The ratio of cooled solid particles in line 40 and/or 42 to the hot solid particles in line 36 is from 10 to 1 to 2 to 1. Heavier components of the pyrolysis effluent are condensed on the cooled solid particles transported through line 44 and are coked onto the solid particles in the transfer line reactor 12. Generally, lines 40 and/or 42 are positioned at a distance of from 2 to 20 feet, preferably 3 to 15 feet from the juncture between line 36 with transfer line reactor 12.

As is readily apparent to one skilled in the art, the residence time of pyrolysis is readily controlled by the distance between the contact point of the hydrocarbon feed with the hot solids particles and the contact point of the pyrolysis effluent including solids particles with the cooled solid particles. The velocity in the transfer line reactor 12 is from 15 to 60 feer per second with a concentration of solids therein of from 1 to 6 pounds per cubic feet.

The pyrolysis products and solid particles are lifted in the transfer line reactor 12 and are introduced into the separator 16 for separation into a gaseous pyrolysis stream withdrawn by line 48 and passed to cooler 18 with a portion of the separated solids from separator 16 being withdrawn and passed by line 50 to the cooler 18. The remaining portion of the solids particles in separator 16 are contacted with steam in line 52 in the stripper 46 to recover hydrocarbon absorbed on the surface of the solids and those entrapped between the solids prior to withdrawal from the separator 16 by line 20 for passage to fluidized coke heater 14.

The solids particles in line 20 together with solids feed, if any, in line 22 are contacted in the fluidized coke heater 14 with air or an oxygeneous gas in line 28 under conditions to provide the hot solid particles in line 36. If the carbonaceous solids in line 24 contain sulfur compounds in an amount to present environmental problems, the combustion in the fluidized coke heater 14 is effected in the presence of calcined limestone introduced by line 26. Combustion is complete at about 1600° F. with the result that sulfur oxides are reduced by reaction with the calcined limestone.

Use of coal or like carbonaceous material from the boiler 14 to furnish the heat necessary for pyrolysis eliminates extraneous heating liquids or fluids, such as oil and/or gas, it being understood that some of the feed is converted to coke or char deposited on the solid particles for subsequent combustion in the fluidized coke heater 14. Additionally, the use of the fluidized coke heater 14 permits the generation of steam by passage of the combustion gases in line 32 in indirect heat transfer relationship (not shown) for on-site plant use or for preheating air in line 28 by indirect heat exchange with flue gas in line 32.

The pyrolysis effluent including stripped components and stripping steam are withdrawn by line 48 from the separator 16 and introduced into the cooler 18 and contact fluidized solids therein including solid particles withdrawn by line 50 from the separator 16 with the pyrolysis effluent in line 48 provides the fluidizing gas requirements therefor. Generally, there are still additional heavier components of pyrolysis in line 48 which are deposited on the solids in cooler 18 thereby to substantially remove such components therefrom. Thus, lighter components of pyrolysis partially cooled and substantially free from heavy components with fouling tendencies on cooling surfaces are withdrawn by line 58 and passed to a cooling fractionation and purification system (not shown).

Operation of the process and apparatus of the present invention is described in the following specific example which is intended to be merely illustrative and the present invention is intended not to be limited thereto.

EXAMPLE

The system is filled with fluid coke for start-up. The coke in the coke heater 14 is heated and maintained at about 1600° F. by burning a portion of the coke. Heavy oil is atomized with about an equal weight of steam and introduced by line 38 into the transfer liner reactor 12. Hot coke in line 36 in an amount of about 10 times of the oil feed is introduced into the transfer line reactor 14 to contact the steam and oil mixture. The oil begins to pyrolyze in contact with the hot coke particles. The pyrolysis reaction is endothermic. Thus, the temperature of the mixture drops to about 1400° F. as it proceeds along the transfer line reactor 14. The final pyrolysis temperature is determined by the degree of conversion desired and the residence time allowed for the heavy oil. The pyrolysis reaction is arrested by introducing a cooled coke stream at 800° F. from coke cooler 18 through line 40 and/or 42 to cool the pyrolyzed mixture to about 1200° F.

For 100,000 lb/hr ethylene production, the heavy oil feed is about 400,000 lb/hr preheated to about 350° F. and atomized with 400,000 lb/hr of 100 psig steam. About 6,800,000 lb/hr of hot coke at 1600° F. is introduced into the transfer line reactor 14 and maintained at a pressure of about 30 psig. The diameter of the reactor is sized to maintain a velocity of 30 ft/sec. At about 10 ft. from the inlet, about 3,800,000 lb/hr of cooled coke at about 800° F. is introduced to cool the mixture to 1200° F. The residence time of the oil and steam mixture in pyrolysis zone is about 0.3 seconds. The residence time can be varied by introducing the cooled coke at different points into the transfer line reactor 14. The temperature in the pyrolysis zone is varied by the temperature and quantities of the hot coke used. The degree of conversion of the heavy oil is achieved by the combination of the residence time and the temperature in the pyrolysis zone.

The pyrolysis products are separated from the coke in the separator 16 and sent to the cooler 18 through conduit 48 and used as fluidizing gas for the cooler 18. A part of the coke, about 3,800,000 lb/hr, separated from the vapor in separator 16 is recycled to the cooler 18 to be cooled to 800° F. in a fluidized bed cooled by thermosyphon water/steam coils 62. The effluent vapor from separator 16 containing unstable high boiling hydrocarbons is contacted in cooler 18 with a cooled fluidized bed of coke. These high boiling hydrocarbons are absorbed by the coke which is recycled to the reactor 12 and ultimately sent to the coke heater 14 where these hydrocarbons are burned. The vapor effluent 58 from the coke cooler is sent to a steam generating cooler (not shown) to be cooled down to about 600° F. generating about 90,000 lb/hr of 750 psig steam. As most of the high boiling unstable hydrocarbons are removed from the vapor, the fouling of the steam generating cooler is much less than that occurring in a transfer line exchanger cooling the effluent stream from a conventional pyrolysis heater.

The cooled stream from such steam generating cooler is sent to a fractionator (not shown) in which the heavy pyrolysis residual oil is separated from the light pyrolysis products. The overhead from the fractionator is sent to a recovery section to purify and recover all the pyrolysis products. The amount of the heavy residual oil recovered can be adjusted to balance the heating oil required for the coke heater 14. The other portion of the coke, about 6,800,000 lb/hr separated out the separator 16, is sent through a stripper 46 in which the reaction products are stripped-out by steam in conduit 52 and returned to the separator 16. The stripped coke is sent to the coke heater 14 through conduit 20.

The heat required to heat 6,800,000 lb/hr of coke from 1200° F. to 1600° F. is about 1,400 million B.t.u/hr at an efficiency of about 80%. The heat from fuel is about $1,700\times10^6$ B.t.u/hr. The amount of coke produced by the pyrolysis reaction is about 10,000 lb/hr and is deposited on the circulating coke. The burning of such coke generates about 140 million B.t.u/hr. The balance of the heat requirement is supplied by burning about 84,000 lb/hr of the heavy residual oil recovered from the fractionator.

About 2,500,000 lb/hr of air is required for the combustion in the coke heater 14. The preheated air is introduced through conduit 28 to the sparger 30 located at the bottom of the fluidized bed in the coke heater 14. The flue gas is separated from the coke in the cyclone 34 and is sent to a heat exchanger by line 32 to preheat the air in the conduit 30 to about 1000° F. The remaining heat of about $400\times10^6$ B.t.u/hr in the flue gas in line 32 is recovered in a heat recovery unit generating medium pressure steam (not shown).

While the present invention has been described with reference to a preferred embodiment thereof and in particular the use of coke or like carbonaceous solid particles as the source material for forming hot solid particles at pyrolysis temperatures, it is understood that other solids and/or other sources of energy may be utilized to substantially instantaneously achieve pyrolysis temperatures and that like cooled solids may be utilized as a quenching medium.

In accordance with the present invention, the direct quench of the pyrolysis effluent resulting from the pyrolysis of a heavy hydrocarbon feed enhances the absorption or deposition on the cooled coke particles of tar, coke or other heavy materials of pyrolysis. The thus formed coke has the advantages of being the same material formed during the pyrolysis and of a high heat capacity capable of being burnt as fuel. The resulting gaseous effluent is substantially free of fouling components thus permitting the use of conventional heat transfer equipment downstream of the separator.

While the invention has been described in connection with an exemplary embodiment thereof, it will be understood that many modifications will be apparent to those of ordinary skill in the art; and that this application is intended to cover any adaptations or variations thereof. Therefore, it is manifestly intended that this invention be only limited by the claims and the equivalents thereof.

I claim:

1. An improved process for the production of ethylene by the pyrolysis of heavy hydrocarbons, which comprises:

(a) heating solid particles to pyrolysis temperatures and introducing said thus heated solid particles into an elongated transfer line reaction zone;

(b) introducing said heavy hydrocarbon into said transfer line reaction zone to intimately contact said heated solid particles with said heavy hydrocarbon under conditions to effect pyrolysis of said heavy hydrocarbons to form a pyrolysis effluent including ethylene;

(c) introducing cooled solid particles into said transfer line reactor zone after said contact and into a combined pyrolysis effluent and hot solid particles stream to quench said pyrolysis effluent and concomitantly cool said hot solid particles;

(d) withdrawing and introducing a quenched pyrolysis effluent and solid particles from said transfer line reaction zone into a separation zone;

(e) separating said quenched pyrolysis effluent from solid particles in said separation zone;

(f) withdrawing and introducing a portion of said solid particles from said separation zone into a heating zone for heating to form said heated solid particles of step (a);

(g) withdrawing and introducing a portion of said solid particles from said separation zone into a cooling zone for cooling to form said cooled solid particles of step (c); and (h) withdrawing quenched pyrolysis effluent including ethylene from said separation zone.

2. The improved process as defined in claim 1 wherein said solid particles are heated to a temperature of from 800° to about 1700° F.

3. The improved process as defined in claim 2 wherein said solid particles are preferably heated to a temperature of from 1200° to 1600° F.

4. The improved process as defined in claim 1 wherein said cooled solid particles are at a temperature of from 500° to 1000° F.

5. The improved process as defined in claim 4 wherein said cooled solid particles are at a temperature of from 700° to 900° F.

6. The improved process as defined in claim 2 wherein weight ratio of said heated solid particles to said hydrocarbon feed is from 25 to 1 to 1 to 1.

7. The improved process as defined in claim 6, wherein said ratio is preferably 15 to 1.

8. The process as defined in claim 1 wherein said cooled solids are introduced into said transfer line reactor zone at a distance of from 2 to 20 feet from step (b).

9. The improved process for the production of ethylene as defined in claim 1 wherein said thus quenched pyrolysis effluent from step (d) is contacted with a portion of solid particles separated in step (d).

10. The improved process for the production of ethylene as defined in claim 9 wherein said thus quenched pyrolysis effluent contact said portion of solid particles under fluidized bed conditions.

11. The improved process for the production of ethylene as defined in claim 10 wherein said fluidized bed is cooled by indirect heat transfer.

12. The improved process for the production of ethylene as defined in claim 1 wherein a portion of said solid particles separated in step (d) are stripped and introduced into a reheating zone to be heated to said pyrolysis temperature.

13. The improved process for the production of ethylene as defined in claim 12 wherein particulate carbonaceous solids are introduced into the reheating zone to provide the energy requirements therefor.

14. The process as defined in claim 1 wherein said solid particles are a carbonaceous material selected from the group consisting of coke or coal.

15. The process as defined in claim 14 wherein said solid particles are coke.

16. An apparatus for the production of ethylene by the pyrolysis of heavy hydrocarbons, which comprises:

an elongated transfer line reactor;

conduit means for introducing hot solid particles at pyrolysis temperatures into said elongated transfer line reactor;

conduit means for introducing said heavy hydrocarbon into said transfer line reactor to effect pyrolysis of said heavier hydrocarbons by contact with said hot solid particles to produce a pyrolysis effluent including ethylene;

conduit means for introducing cooled solid particles into said transfer line reactor to quench said pyrolysis effluent and to cool said hot solid particles, said conduit means for introducing said cooled solid particles being disposed at a point above said conduit means for introducing said hot solid particles into said transfer line reactors;

separation vessel for separating quenched pyrolysis effluent from solid particles;

conduit means for withdrawing quench pyrolysis effluent and solid particles from said transfer line reactor and introducing same into said separation vessel;

heating vessel for heating solid particles to pyrolysis temperatures;

conduit means for passing solid particles from said separation zone to said heating vessel, said heating vessel being in solids flow communication with said conduit means for introducing said heat solid particles into said elongated transfer line reactor;

cooling vessel for cooling solids particles; and conduit means for passing solids particles from said separation zone to said cooling vessel, said cooling vessel being in solids flow communication with said conduit means for introducing said cooled solid particles into said elongated transfer line reactor.

17. The improved appartus as defined in claim 16 wherein said conduit means for said cooled solid particles in from 2 to 20 feet above said conduit means for said hot solid particles.

18. The improved apparatus for the production of ethylene as defined in claim 16 wherein said heating vessel is a fluidized bed boiler.

19. The improved apparatus for the production of ethylene as defined in claim 18 wherein said fluidized bed boiler includes means for introducing particulate carbonaceous particles into said fluidized bed boiler.

20. The improved apparatus for the production of ethylene as defined in claim 16 further comprising a conduit means for passing cooled solid particles from said cooling vessel to an upper portion of said separation zone for contacting quench pyrolysis gas therein.

21. The improved apparatus for the production of ethylene as defined in claim 20 wherein said cooling vessel includes a fluidized bed of particulate solids.

22. The improved process for the production of ethylene as defined in claim 1 and further comprising the steps contacting a portion of the cooled solid particles from step g with quenched pyrolysis effluent containing ethylene in a fluidized bed of said separation zone to remove heavier components from said ethylene containing pyrolysis effluent.

23. The improved process as defined in claim 14 wherein said solid particles are coal and reheating is effected in the presence of limestone.

24. The process as defined in claim 1 wherein step (c) is effected to provide a pyrolysis residence time of from 0.02 to 1 second in said transfer line reaction zone.

25. The apparatus as defined in claim 16 wherein said conduit means for introducing said cooled solid particles is positioned on said elongated transfer line reactor to effect a pyrolysis residence time of from 0.02 to 1 second in said elongated transfer line reactor.

* * * * *